US009373312B1

(12) United States Patent
Block

(10) Patent No.: US 9,373,312 B1
(45) Date of Patent: Jun. 21, 2016

(54) STABLE POSITIONING HARNESS FOR SUSPENDING A MUSICAL INSTRUMENT ON THE PLAYER

(71) Applicant: Michael G Block, Somerville, MA (US)

(72) Inventor: Michael G Block, Somerville, MA (US)

( * ) Notice: Subject to any disclaimer, the term of this patent is extended or adjusted under 35 U.S.C. 154(b) by 0 days.

(21) Appl. No.: 15/000,331

(22) Filed: Jan. 19, 2016

Related U.S. Application Data

(60) Provisional application No. 62/105,505, filed on Jan. 20, 2015.

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 3,833,751 A * 9/1974 Chapman ..... G10H 3/18 84/327
5,332,137 A 7/1994 Violette
5,596,158 A 1/1997 Tonon
5,824,924 A * 10/1998 Agostino ..... G10H 3/18 84/291
6,040,509 A 3/2000 Fanella
6,084,165 A * 7/2000 Chapman ..... G10D 1/085 84/267
6,359,203 B1 * 3/2002 Cronos ..... G10G 5/005 84/280
7,375,269 B2 * 5/2008 Perkins ..... G10D 3/003 224/910
7,385,125 B2 6/2008 Motsenbocker
9,190,041 B1 * 11/2015 Miller ..... G10G 5/005
9,257,110 B1 * 2/2016 Smith ..... G10G 5/005

* cited by examiner

*Primary Examiner* — Robert W Horn
(74) *Attorney, Agent, or Firm* — Altman & Martin; Steven K Martin

(57) ABSTRACT

A harness for suspending a large stringed instrument on the player. A peg belt wraps around and secures the harness to the peg box. A strap assembly stretches diagonally across the player's back from the peg belt to the endpin or anchor. The strap assembly has a central sash with a bottom extension and a top extension. Optional detachable sash cushions attach to the inner surface of the sash. An eyelet in the bottom extension attaches at the endpin. A neck connector extends from the outer surface of the sash near the top end of the sash. The free end of the neck connector loops between the neck/fingerboard and instrument body and detachably attaches to the free end of the top extension. The peg belt detachably attaches to the neck connector. An optional chest cushion hangs from the instrument where the neck/fingerboard attach to the instrument body.

14 Claims, 6 Drawing Sheets

STABLE POSITIONING HARNESS FOR SUSPENDING A MUSICAL INSTRUMENT ON THE PLAYER

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to musical instrument support, and specifically to a strap-like harness for positioning a cello, guitar, bass, or other like instrument about the body of the player.

2. Description of the Related Art

The existence of a musical instrument called Violoncello, now commonly referred to as the "Cello", dates back to the mid-1600s. By 1700, it was customary for the player to hold the instrument between the knees while seated, and support it with the calves. In 1846, the Belgian cellist A. F. Servais was the first to adopt an adjustable endpin, a metal spike that holds the cello above the ground, relieving the player from having to support it with the calves. Today, the endpin is still used universally by cellists from the moment they start learning to play. The player can adjust the length of the endpin to customize the height of the instrument. The amount of distance in front of the player chosen for the floor placement of the bottom of the endpin affects the oblique angle of the instrument in relation to the player's torso. The cello player places the instrument between the legs to stabilize it and to customize the rotational angle of the instrument upon contact with the knees. These standard practices allow cellists to play their instrument healthfully in accordance with ergonomic principles governing proper body mechanics and has resulted in widely accepted standards of traditional cello technique.

Despite the long tradition of playing a cello seated with an endpin, an obvious limitation to this approach is that cello cannot be played with traditional standards of technique while standing, walking, dancing, or rotating/bending the torso. This severely limits the player in many ways, including:

1. General physical mobility and freedom. Cellists are not able to stand, walk, dance, rotate, or bend the torso while maintaining effective and healthy technique.

2. Creative possibilities. The lack of physical freedom can inhibit a performer's expressiveness, as well as severely limit staging and choreography options.

3. Communication with other performers. Cellists are often the only musician to sit during performance, and must awkwardly twist the neck to look sideways and upwards at other performers.

4. Interaction with audiences. Cellists are unable to move around the stage or into the audience.

5. Visibility to audiences. If the stage is not raised high enough, an audience is often not able to see seated performers, particularly in venues where the audience is standing.

6. The professional opportunities available to cellists. Because cellists are generally thought of as seated performers who must remain stationary, they are not asked as frequently as other instrumentalists to participate in performances involving choreography or physical mobility while playing.

There exist electric cellos that are manufactured to be played while standing up, such as the NS Design, and Mark Wood's Cobra. However, these harness systems are built into the instrument's design and are not able to be adapted to existing acoustic instruments. Also, most cellists and audiences prefer the sound and look of acoustic instruments, even when being amplified. Therefore, electric cellos are not appropriate in most professional situations.

Many musical instruments, such as acoustic guitars, electric guitars, bass guitars, banjos, mandolins, etc., are manufactured with strap anchors to accommodate the common practice of using a strap harness to hold these instruments up while standing or sitting. Acoustic cellos are not made with strap anchors since it is traditionally played from a sitting position. Furthermore, drilling into an acoustic instrument to insert an anchor would damage its acoustical properties. Since high-quality instruments are worth thousands of dollars, such modifications would also decrease their value.

There have been a small number of non-traditional cellists who have adapted existing dual-anchor guitar or bass guitar straps to hold the cello during playing, allowing them to stand. This has been done without installing strap anchors by tying a rope or string from one end of the strap around the neck of the instrument, while the other end of the strap is held in place by screwing the endpin over it. Unfortunately, the adaptation of straps intended for other instruments does not enable the cello to be properly positioned relative to a player's body according to traditional cello technique standards, or ergonomic design principles that help the player avoid injury over extended use. Therefore, using a strap to hold the instrument in this way has not been widely adopted by cellists.

U.S. Pat. No. 7,385,125 teaches a two-point anchor system for an electric cello. However, since it is intended for only electric instruments, this design requires strap anchors inserted into the body of the instrument. Thus, one could not use this system on acoustic instruments without damaging its acoustical properties and lowering its value.

U.S. Pat. No. 6,040,509 teaches a three-point anchor for suspending an acoustic guitar. However, this system does not accommodate an instrument of the cello's size and shape, nor can it position the instrument obliquely or rotationally in accordance with standard cello technique.

U.S. Pat. No. 5,596,158 also teaches a three-point anchor for suspending an acoustic guitar. This system suffers identical limitations: it does not accommodate an instrument of the cello's size and shape, nor can it position the instrument obliquely or rotationally in accordance with standard cello technique. Regardless, the status of this patent is Expired.

U.S. Pat. No. 5,332,137 teaches a three-point anchor system for an electric bass guitar. However, because this design requires a strap anchor inserted into the body of the instrument, it could not be used on an acoustic instrument. It is also not designed to accommodate the oblique and rotational angles required for traditional cello technique standards.

U.S. Pat. No. 6,359,203 teaches a three-point anchor system for suspending an electric instrument of the guitar family in a near vertical position, closer to how a cello is played than a guitar. However, this design also requires strap anchors inserted into the body of the instrument and, therefore, cannot be used on an acoustic instrument. It is also not designed to accommodate the oblique and rotational angles required for traditional cello technique standards.

All prior art strap harnesses used in conjunction with either a two or three-point anchor system cannot facilitate proper ergonomic positioning of the instrument relative to a player's body in accordance with traditional standards of cello technique, particularly in regards to parameters that include the oblique angle, rotational angle, depth, and height of the instrument. Furthermore, since they require strap anchors to be inserted into the instrument, they all fail to specifically address the problem of use with existing acoustic instruments where, as stated, instrument modification is detrimental to its monetary value and acoustical properties.

BRIEF SUMMARY OF THE INVENTION

The present invention is a harness for suspending a cello, guitar, or other like musical instrument on the player. It is intended for use with stringed instruments having a body, a neck extending away from the body at a neck attachment, a peg box with pegs at the free end of the neck, and an endpin or other anchor on the body opposite the neck.

The harness includes a peg belt, strap assembly, and neck connector.

The peg belt is a flexible strip that wraps around and secures the harness to the peg box of the instrument. The ends of the strip have a detachable fastener to secure the peg belt as a loop around the peg box. In one configuration, the peg belt has openings that fit over the tuning peg so that the tuning pegs retain the peg belt in position. Alternatively, there are no openings and the peg belt fits between tuning pegs.

The strap assembly stretches diagonally across the player's back from the peg belt to the instrument anchor. The main portion of the strap assembly is the sash that stretches from the neck and left shoulder area of the player around the player's back. Optionally, the inner surface of the sash is lined with one or more hook and loop fastener strips to which a player can attach one or more optional sash cushions by mating hook and loop fastener strips. Alternatively, the sash can have integral padding.

A bottom extension extends from the bottom end of the sash. The free end of the bottom extension has an eyelet for attaching to the endpin. The endpin is removed from the instrument, inserted through the eyelet, and screwed back into the instrument. If the endpin is not removable or the instrument does not have an endpin, the free end of the bottom extension is attached to the instrument in whatever manner is appropriate.

A top extension extends from the top end of the sash and a neck connector attaches to and extends from the outer surface of the sash near the sash top end. The free end of the neck connector attaches to the free end of the top extension via a quick-release buckle. The neck connector is looped between the neck/fingerboard and instrument body where the neck of the instrument connects to the body, thereby attaching the harness to the instrument.

In one configuration, the neck connector is a single component. In another configuration, the neck connector includes a neck extension and a back extension. The back extension is attached to the outer surface of sash to form a loop. The neck extension has a loop that links with the loop of the back extension.

The peg belt attaches to the neck connector by a quick release buckle.

An optional chest cushion hangs from the instrument where the neck/fingerboard attach to the instrument body. The chest cushion has a pouch with one or more pads inside.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
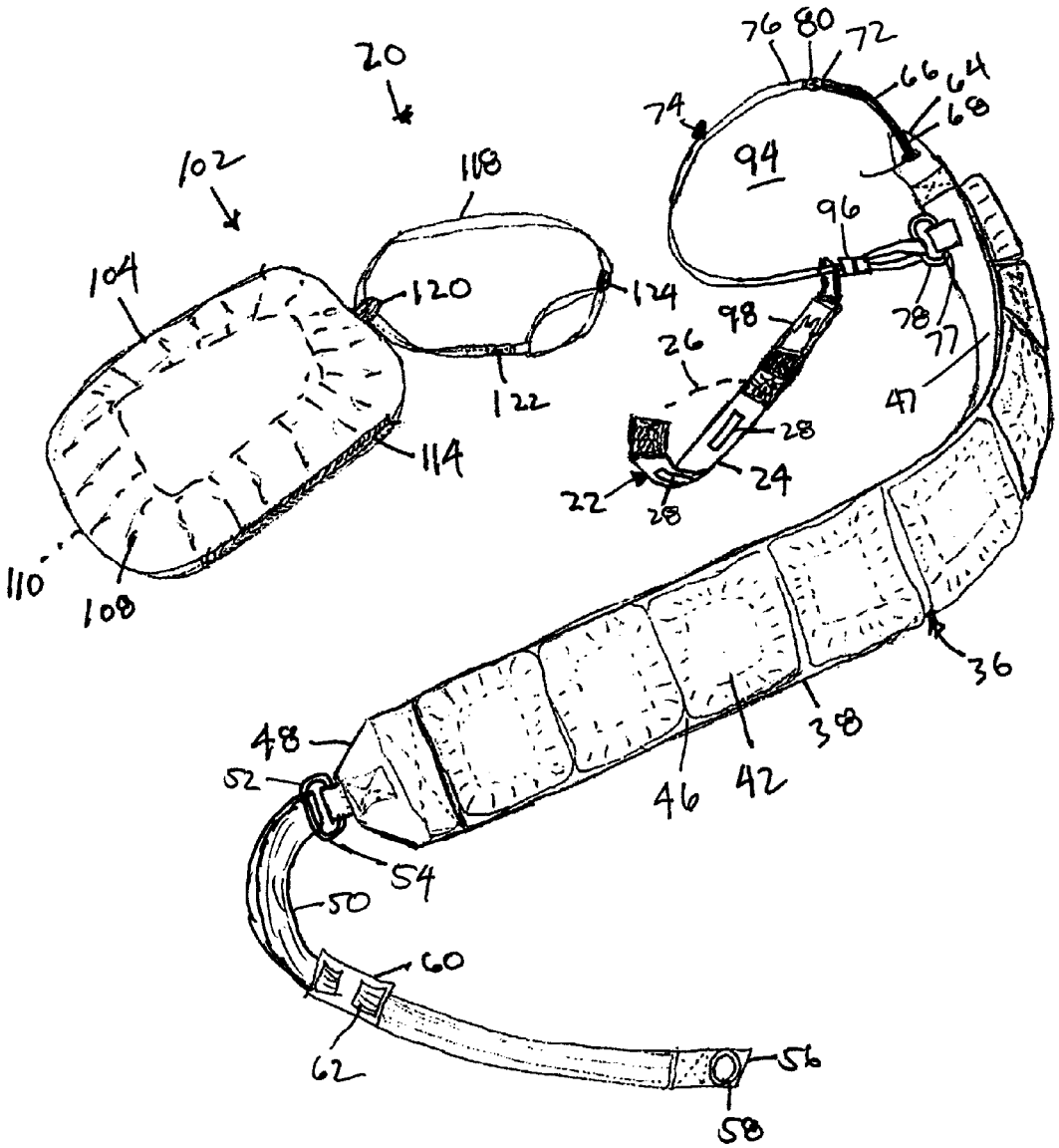
FIG. 1 is an assembled view of the harness of the present invention.

The present application hereby incorporates by reference in its entirety U.S. Provisional Patent Application No. 62/105,505, on which this application is based.

The present invention is a harness 20 capable of suspending a cello, guitar, or other like musical instrument 2 on the player, and enables precise control and subtle manipulation of the instrument position in relation to the player's body in a closer accordance with the principles governing proper body mechanics and traditional standards of playing technique. The harness 20 is intended for use with a stringed instrument 2 having a body 12, a neck 10 extending away from the body at a neck attachment 14, a peg box 4 with pegs 6 at the free end of the neck 10, and an endpin or other anchor 8 on the body 12 opposite the neck 10.

The present specification describes how the present invention is adapted for a cello and the typical dimensions described are appropriate for a cello. However, it should be understood that the present invention is also suitable for other instruments and the dimensions can be modified accordingly.

The harness 20 of the present invention properly positions a musical instrument 2 relative to a player's body, in accordance with traditional technique standards and principles of ergonomic use and body mechanics. The harness 20 provides the following:

a. It facilitates the suspension of an acoustic or electric cello in a standing or sitting position, in accordance with traditional standards of cello technique and in closer accordance with the ergonomic principles governing proper body mechanics.

b. It provides adequate control of the oblique angle of the instrument in relation to the player's torso, in accordance with traditional standards of technique.

c. It provides adequate control of the rotational angle of the instrument, in accordance with traditional standards of technique.

d. It provides adequate control of the height of the instrument, in accordance with traditional standards of technique.

e. It provides adequate control of the depth of the instrument, in accordance with traditional standards of technique.

f. It provides adequate control of the lateral placement of the instrument, in accordance with traditional standards of technique.

g. It provides adequate control of the distribution of weight of the instrument, in accordance with traditional standards of technique.

h. It facilitates ergonomic playing of the instrument while attempting to reduce pain over extended use.

i. It minimizes the muscular effort and strain necessary to carry the weight of the instrument.

j. It facilitates the attachment of the harness by a three-point system without the need for drilling into the instrument's body to insert strap anchors.

k. It facilitates greater rotational mobility of the player while seated or standing by not anchoring the instrument to the floor with the endpin.

l. It facilitates greater freedom of foot and leg placement for the player while seated or standing by relieving the player from the need to hold the instrument securely in place with the knees in combination with the endpin.

m. It facilitates greater mobility of the player around stage to walk, run, or dance.

n. It facilitates distribution of the instrument's weight on the player's body.

o. It facilitates an unobstructed bowing path for the player's right arm.

p. It facilitates free movement of the left thumb along the back of the neck.

q. It allows the instrument to fit into standard instrument cases without removing the harness.

The harness 20 attaches to the musical instrument 2 at three separate and distinct locations with the optional use of at least one cushion 102 between the player and the instrument 2. The harness 20 stabilizes the instrument 2 properly and its position can be customized by the player in numerous ways, including height, depth, oblique angle, rotational angle, lateral placement, and distribution of the instrument's weight upon the player, as described below.

The harness 20 has a peg belt 22 that wraps around and secures the harness 20 to the peg box 4 of the instrument 2. The peg belt 22 consists of a rectangular strip 24 of polyester or nylon webbing, leather, or other flexible fabric-like material. The strip 24 is about 1 inch wide and 8 inches long, appropriate for a cello, and may have different dimensions for a different instrument.

The ends of the strip 24 are attached together via a detachable fastener 26 to secure the peg belt 22 as a loop around the peg box 4. Any adequate detachable fastener 26 can be used, including hook and loop fasteners, snaps, hooks and eyes, quick-release buckle, etc.

The length of the peg belt 22 generally does not need to be adjusted. However, if adjustment is desirable, the detachable fastener 26 can be used. A hook and loop fastener can be fastened at different positions. For snaps and hooks, there can be several at different longitudinal locations on the strip 24.

In one configuration, the peg belt 22 has one or more openings 28 that fit over the tuning pegs 6. The tuning pegs 6 help prevent the peg belt 22 from sliding up and down the peg box 4, thereby retaining the peg belt 22 in the desired position. The openings 28 are typically elongated slots so that the finger portion of the tuning peg 6 will fit through. The choice of which tuning pegs 6 to fit the peg belt 22 on determines, in part, the position of the instrument 2 relative to the player's body.

In another configuration, the peg belt 22 fits between tuning pegs 6 so that the tuning pegs 6 straddle the peg belt 22 to retain it in position. This configuration does not need the openings 28.

The strap assembly 36 stretches diagonally across the player's back from the peg belt 22 around the peg box 4 to the anchor 8 at the bottom of the instrument 2.

The main portion of the strap assembly 36 is the sash 38, which is a wide, rectangular strip of polyester or nylon webbing, leather, or other flexible fabric-like material that stretches diagonally from the neck and left shoulder area of the player around the player's back. The sash 38 is two to four inches wide and 28 to 36 inches long. In the present design, the sash 38 is 3⅛ inches wide and 32 inches long.

Optionally, the inner surface 46 of the sash 38 is lined with one or more hook and loop fastener strips 40 to which a player can attach one or more optional sash cushions 42 by mating hook and loop fastener strips 44. The sash cushions 42 enhance the comfort of the player.

A sash cushion 42 is a soft bag made of cloth, polyester or nylon webbing, leather, plastic, or comparable flexible fabric, filled with polyester, feathers, foam, cotton, or other yielding substance. One side of the sash cushion 42 is covered with a hook and loop fastener 44 that mates with the hook and loop fastener strip 40 on the inner surface 46 of the sash 38. In the present design, the sash cushion 42 is about 2½ inches wide, 3½ inches long, and 1½ inches thick. The small size permits the user to place as few or as many sash cushions 42 as desired for comfort and positioning.

An alternative option is that the inner surface 46 of the sash 38 is permanently padded, that is, the padding is integral to the sash 38 and cannot be removed.

At the right side of the player's torso, a bottom extension 50 extends from the bottom end 48 of the sash 38. The bottom extension 50 is a rectangular strip of polyester or nylon webbing, leather, or other flexible fabric-like material. The bottom extension 50 is about one inch wide, but can vary as desired.

In one configuration, the bottom extension 50 is a separate component with a top end that is permanently sewn to the bottom end of the sash 38. In another configuration, the bottom extension 50 is not a separate component from the sash 38, but is merely a longer, narrower end to the sash 38. In the configuration of the present design, the bottom extension 50 is attached to the sash 38 through a ring 52 permanently attached to the sash 38. The free end 56 of the bottom extension 50 fits through the ring 52, as at 54, and loops back and through a plastic or metal sliding adjuster 60 that is attached to the sash end 62 of the bottom extension 50. The sliding adjuster 60 permits the user to adjust the length of the bottom extension 50. In the present design, the bottom extension is approximately 30 inches long at full extension.

In one configuration, the free end 56 of the bottom extension 50 has an eyelet 58. Optionally, the eyelet 58 is reinforced by a grommet made of plastic, metal, or other strong material. The eyelet 58 has an internal diameter wide enough to insert the top end of the endpin 8 which, for a cello, ranges from 8 mm to 12 mm in diameter. The endpin 8 is removed from the instrument 2, inserted through the eyelet 58, and screwed back into the instrument, thereby attaching the strap 36 to the instrument 2 without needing to insert a strap anchor into the instrument 2.

For instruments that do not have an endpin or a removable endpin, the free end 56 is adapted to attach to the existing anchor in an appropriate manner. For example, the free end 56 can tied around the non-removable end pin 8. Alternatively, the free end 56 can be removably attached to an existing strap anchor on, for example, a guitar or bass guitar, or any other object in that general area of the instrument 2, for example, the tailpiece 16 and tailpiece wires 18. The term, anchor, in the claims is intended to encompass endpins, strap anchors, and any other mechanism at or near the end of the instrument for holding a strap.

A top extension 66 extends from the top end 64 of the sash 38. The top extension 66 is a narrow, rectangular strip of polyester or nylon webbing, leather, or other flexible fabric-like material. In the present design, the top extension 66 is about ⅜ inch wide. In one configuration, the top extension 66 is a separate component with a top end that is permanently sewed to the top end 64 of the sash 38. In another configuration, the top extension 66 is not a separate component from the sash 38, but is merely a longer end to the sash 38.

In the present design, the sash end 68 of the top extension 66 is inserted through a slit 70 at the top end 64 of the sash 38. The sash end 68 is looped back and sewn to retain the top extension 66 in the slit 70. Optionally, the slit 70 has a reinforcing grommet made of plastic, metal, or other strong material. In the present design, the top extension 66 extends about 6 inches from the top end 64 of the sash 38.

Alternatively, the top extension 66 is attached to the sash 38 using any of the methods discussed relative to the bottom extension 50 attachment to the sash 38.

A neck connector 74 is a narrow, rectangular strip of polyester or nylon webbing, leather, or other flexible fabric-like material. In the present design, the neck connector 74 is about ⅜ inch wide.

A basic neck connector 74 is shown in FIG. 1. One end of the neck connector 74 attaches to the outer surface 47 of the sash 38 near the sash top end 64, in the present design, about 7 inches from the top end 64. The actual distance can vary depending on the particular design. Optionally, the neck connector 74 is attached to the sash 38 through a ring 78 attached to the outer surface 47 of the sash 38. The free end 76 of the neck connector 74 fits through the ring 78, as at 77, and loops back and through a plastic or metal sliding adjuster 96 that is attached to the sash end 79 of the neck connector 74. The sliding adjuster 96 allows the user to adjust the length of the neck connector 74. In the present design, the neck connector 74 is approximately 40 inches long at full extension.

The free end 76 of the neck connector 74 attaches to the free end 72 of the top extension 66 via a quick-release buckle 80.

Figure 2:
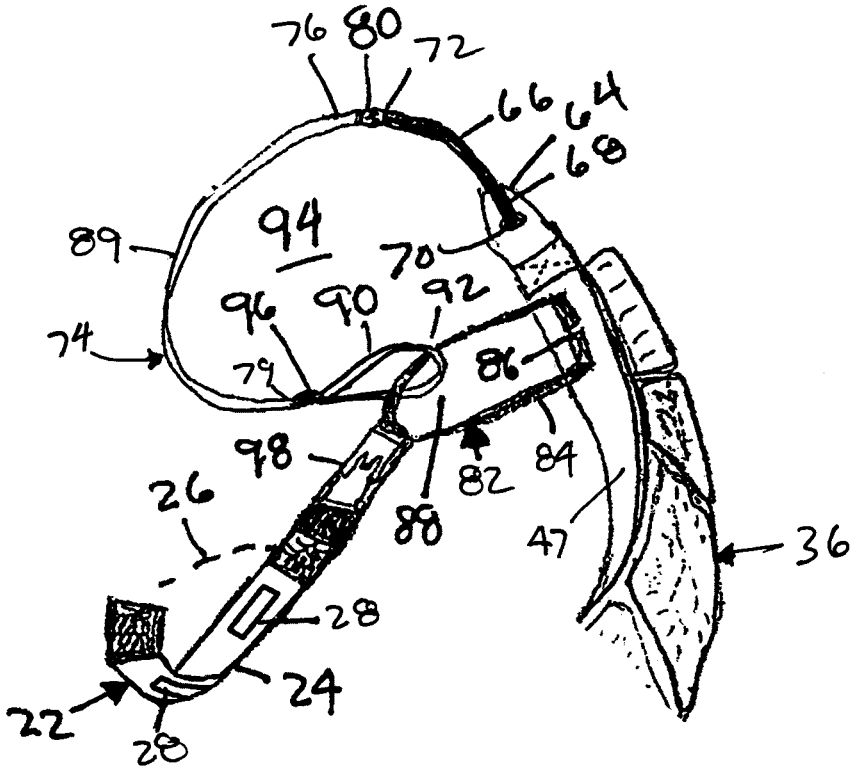
FIG. 2 is an alternate neck connector configuration.
Figure 3:
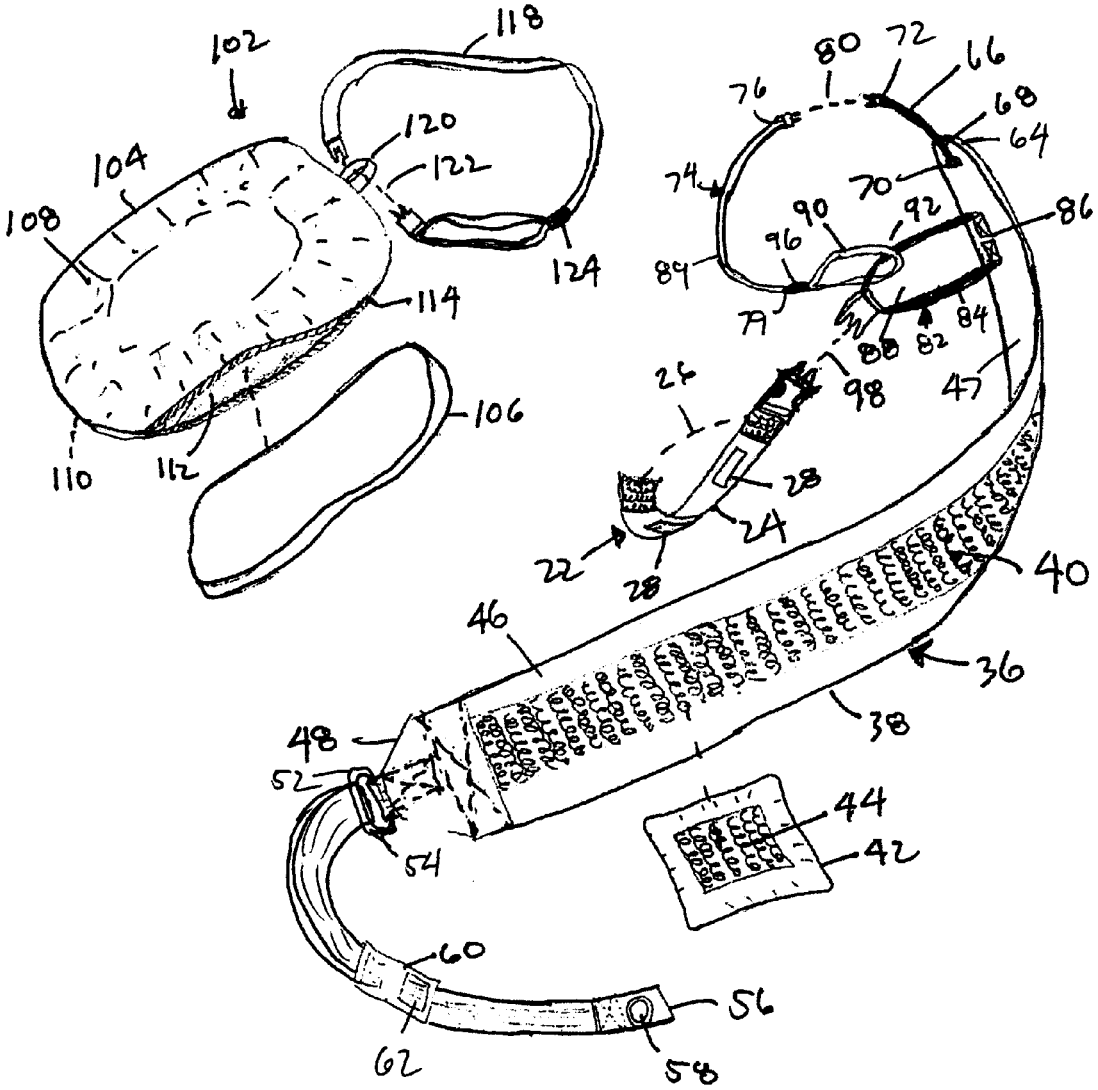
FIG. 3 is an unassembled view of the harness of FIG. 1 with the neck connector configuration of FIG. 2.
Figure 4:
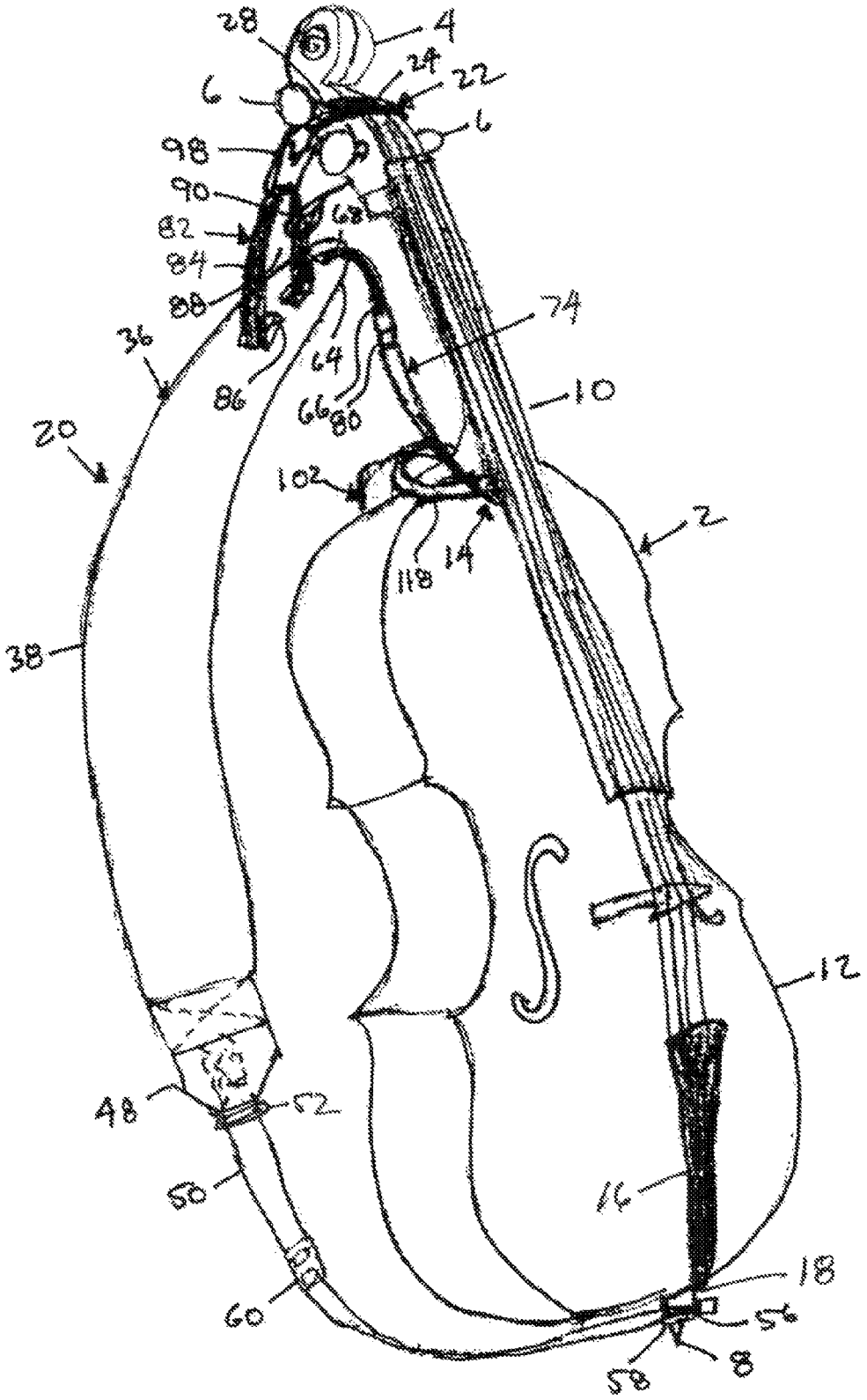
FIG. 4 is a right front perspective view of the harness installed on a cello.

Another configuration of the neck connector 74 is shown in FIG. 2. The neck connector 74 is composed of a neck extension 89 and a back extension 82. The back extension 82 is a rectangular strip 84 of polyester or nylon webbing, leather, or other flexible fabric-like material about one inch wide. Both ends of the strip 84 are attached to the outer surface 47 of sash 38, as at 86, to form a loop 88. In the present design, the strip 84 is about 9 inches long, so the center of the back extension 82, when pulled away from the sash 38, extends about 4½ inches.

Optionally, the length of the back extension 82 is adjustable. The present invention contemplates that one end of the strip 84 can be attached to the sash 38 via a ring in the same manner that the bottom extension 50 is attached to the sash 38. A plastic or metal sliding adjuster permits the user to adjust the length of the back extension 82.

The neck extension 89 has a loop 90 formed by a plastic or metal sliding adjuster 96. The loop 90 links with the loop 88 of the back extension 82, as at 92. The sliding adjuster 96 is used to adjust the length of the neck extension 89.

Figure 5:
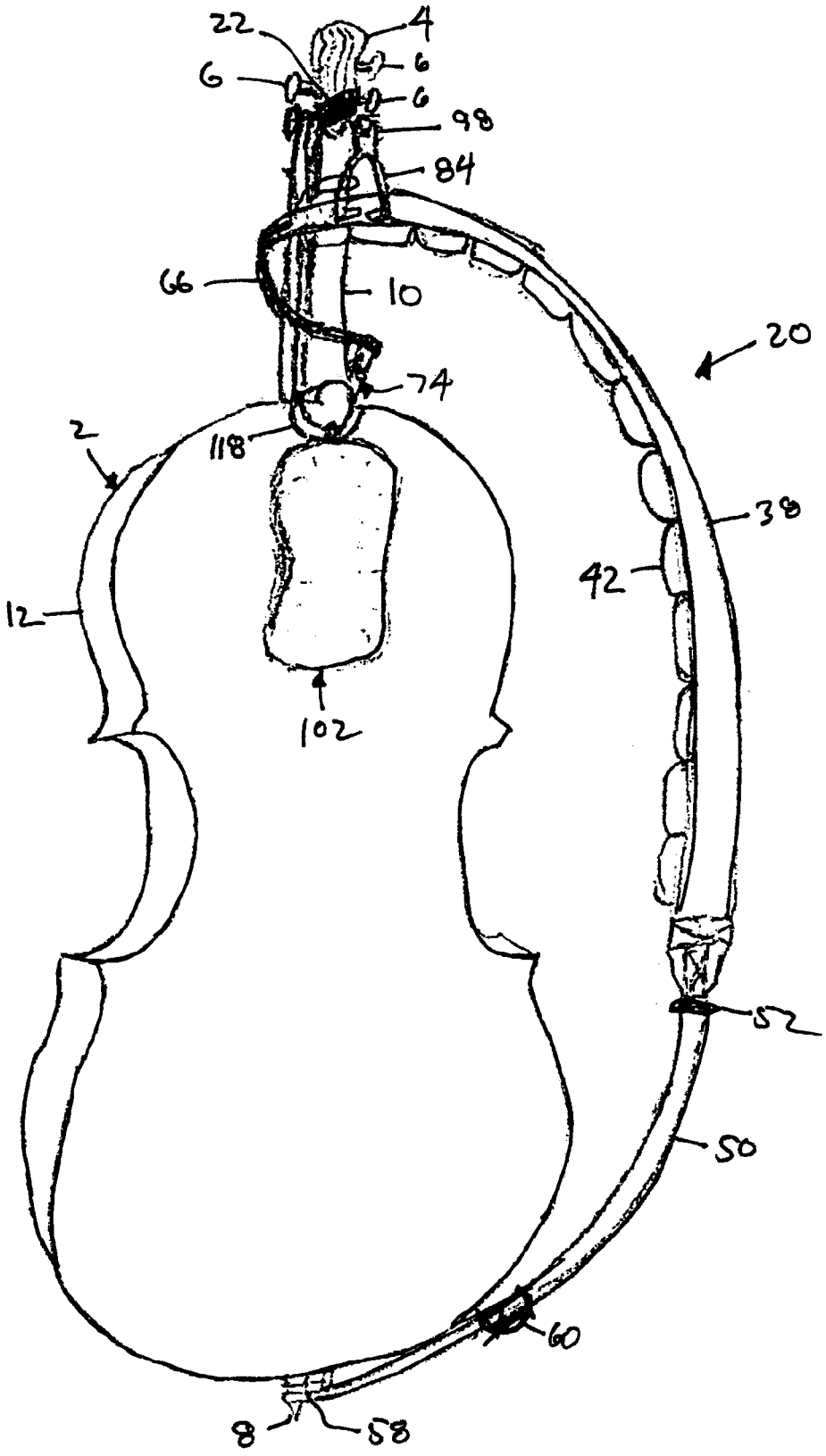
FIG. 5 is a rear perspective view of the harness installed on a cello.
Figure 6:
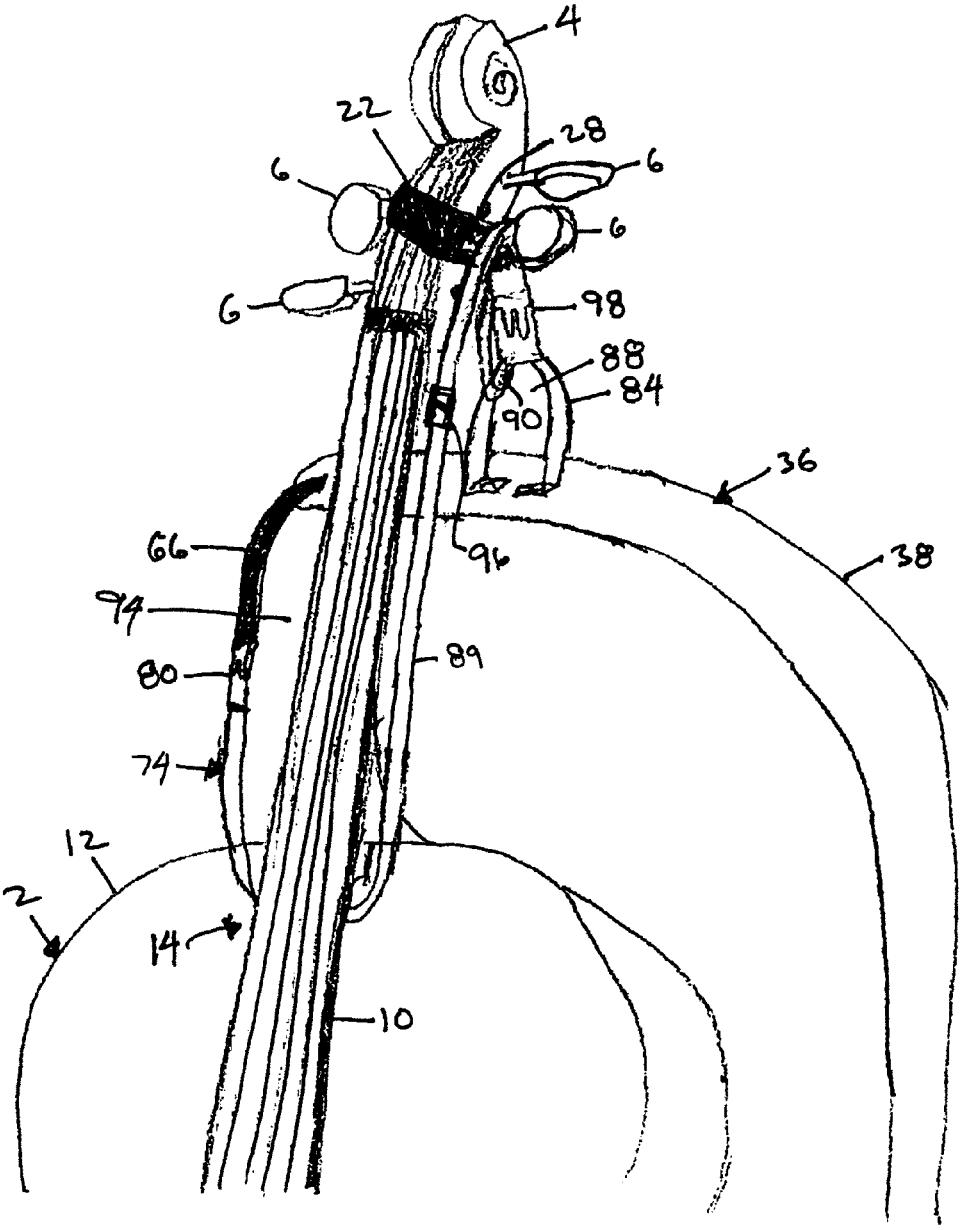
FIG. 6 is a detail perspective view of the harness installed on the cello peg box.

The neck connector 74 is looped between the neck/fingerboard 10 and instrument body 12 where the neck 10 of the instrument 2 connects to the body 12, as at 14 in FIG. 5, thereby attaching the harness 20 to the instrument 2 without needing to insert a strap anchor into the instrument 2.

Optionally, the player's neck/head can be inserted through the loop 94 created by the connected neck connector 74/top extension 66, or it can be positioned outside to the left or right, depending on the player's preference.

The peg belt 22 attaches to the neck connector 74 by a quick release buckle 98 on the neck connector 74. Optionally, the buckle 98 can slide along the neck connector 74 for adjustability.

An optional chest cushion 102 fits between the instrument 2 and the player and comprises a pouch 104 with one or more resilient, compressible pads 106 inside. In the present design, the chest cushion 102 is approximately 8 inches long, 5 inches wide, and 3 inches thick. The thickness can be adjusted by varying the thickness of the pads 106, as described below.

The back surface 108 of the pouch 104, the surface that contacts the player, is made of a soft, breathable fabric. The front surface 110 of the pouch 104, the surface that abuts the instrument 2, is made of a textured material that creates friction with the instrument 2 to prevent it from unintentionally sliding out of place.

The pad 106 can be made of polyester, feathers, foam, cotton, or other yielding material. The pad 106 can be composed of a single layer of one material or it can be composed of multiple layers of the same or different materials. The user can customize the chest cushion 102 by the selection and thickness of pad layers.

The pad 106 can be permanently sewn into the pouch 104 or can be removable for cleaning and customization. The removable pad 106 can be installed through an opening 112 on one side of the pouch 104. The opening 112 is closed by an openable fastener, such as a zipper, hook and loop fasteners, snaps, buttons, etc.

The chest cushion 102 hangs from the instrument 2 by a cushion tie 118. The cushion tie 118 is a ribbon of polyester or nylon webbing with ends that attach together via a quick-release buckle 122. In the present design, the cushion tie 118 is about ⅜ inch wide. The cushion tie 118 is attached to the chest cushion 102 by inserting it through a D-ring, stitched eyelet, or fabric loop 120 on one end of the pouch 104. The length of the cushion tie 118 can be adjusted via a plastic or metal sliding adjuster 124. When at full length, the cushion tie 118 is approximately 16 inches long.

As with the neck connector 74, the cushion tie 118 is threaded between the neck/fingerboard 10 and instrument body 12 where the neck 10 of the instrument 2 connects to the body 12.

The harness 20 of the present invention permits many adjustments to customize the instrument's position relative to the player's body. The following adjustments are possible:

a. The bottom extension sliding adjuster 60 can be used to change the length of the bottom extension 50, primarily affecting the height, and oblique angle.

b. The manner by which the bottom extension 50 contacts the cello above the endpin 8 can be adjusted, primarily affecting the rotational and oblique angles. Options include, but are not limited to, running along the side rib of the instrument 2 so as to not be visible to an audience, running diagonally along the front bottom of the instrument body 12, and threading under the tailpiece or through other components of the instrument 2 in order to stabilize the instrument 2 further.

c. The neck connector sliding adjuster 96 can be used to change the length of the neck connector 74, primarily affecting the oblique angle and height.

d. The neck connector 74 can be wrapped around the instrument's tuning pegs 6 and/or peg box 4 to further adjust the rotational and oblique angles, as well as distribution.

e. The neck connector 74 can be wrapped around the tuning peg 6 of the highest string on the lower left side of the peg box 4 in order to run along the outside left side of the instrument's neck/fingerboard 10, preventing it from becoming an obstacle to the left thumb's movement during playing.

f. The chest cushion tie adjuster 124 can be used to adjust the length of the chest cushion tie 118, effecting the location of the chest cushion 102 between the player and instrument 2, primarily affecting the height, oblique angle, rotational angle, and the depth of the instrument 2 in regards to the distance from the player.

g. The thickness of the chest cushion pad 106 can be adjusted, primarily affecting the oblique angle, rotational angle, and the depth of the instrument 2 in regards to the distance from the player.

h. The location of the peg belt 22 can be adjusted. The user can choose different tuning pegs 6 to insert through the openings 28 in the peg belt 22, primarily changing the height, rotational, and/or oblique angles.

i. The placement and number of sash cushions 42 attached to the inner surface 46 of the sash 38 can be changed to enhance comfort and to adjust the height and/or depth of the instrument 2 relative to the player's body.

j. The user can customize the rotational angle, oblique angle, and depth of the instrument by varying the degree of thickness in different parts the chest cushion 102 with the chest cushion pads 106.

k. The lateral placement of the instrument 2 can be customized by adjusting where the chest cushion 102 makes contact with the instrument 2, as well as where it makes contact with the torso of the player.

l. The distribution of weight can be adjusted to preference by fine-tuning where the sash 38 rests on the left shoulder.

Thus it has been shown and described a stable positioning harness to suspend a musical instrument on the player. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An instrument harness for a stringed instrument that includes a body, a neck extending away from the body at a neck attachment, a peg box with pegs at the free end of the neck, and an anchor on the body opposite the neck, the harness comprising:

(a) a strap assembly having a sash with a top end, a bottom end, an outer surface, and an inner surface, the strap assembly including a bottom extension that extends from the bottom end of the sash to a free end adapted to be removably attached to the instrument at the anchor, a top extension that extends from the top end of the sash to a free end;

(b) a neck connector attached to the outer surface of the sash near the top end and adapted to removably loop between the neck and instrument body at the neck attachment, a free end of the neck connector being detachably attached to the free end of the top extension; and (c) a peg belt adapted to removably wrap around the peg box, the peg belt being detachably attached to the neck connector.

2. The instrument harness of claim 1 wherein the peg belt includes holes adapted to fit on the tuning pegs.

3. The instrument harness of claim 1 wherein the inner surface of the sash is padded.

4. The instrument harness of claim 1 further comprising a plurality of sash cushions removably attachable to the inner surface of the sash.

5. The instrument harness of claim 1 further comprising an eyelet at the free end of the bottom extension adapted to be removably attached to the instrument at the anchor.

6. The instrument harness of claim 1 wherein the length of the bottom extension is adjustable.

7. The instrument harness of claim 1 wherein the length of the neck connector is adjustable.

8. The instrument harness of claim 1 wherein the neck connector includes a neck extension and a back extension, the back extension forming a loop attached to the outer surface of the sash, the neck extension attached to the loop and having the neck connector free end detachably attached to the free end of the top extension.

9. The instrument harness of claim 1 further comprising a chest cushion, the chest cushion having a pouch, at least one pad within the pouch, and a tie adapted to removably loop between the neck and instrument body at the neck attachment.

10. An instrument harness for a stringed instrument that includes a body, a neck extending away from the body at a neck attachment, a peg box with pegs at the free end of the neck, and an anchor on the body opposite the neck, the harness comprising:

(a) a strap assembly having a sash with a top end, a bottom end, an outer surface, and an inner surface, the strap assembly including a bottom extension extending from the bottom end of the sash with an adjustable length to a free end adapted to be removably attached to the instrument at the anchor, and a top extension extending from the top end of the sash to a free end;

(b) a plurality of sash cushions removably attachable to the inner surface of the sash;

(c) a neck connector attached to the outer surface of the sash near the top end and adapted to removably loop between the neck and instrument body at the neck attachment, the neck connector having an adjustable length, a free end of the neck connector being detachably attached to the free end of the top extension;

(d) a peg belt adapted to removably wrap around the peg box, the peg belt being detachably attached to the neck connector; and (e) a chest cushion, the chest cushion having a pouch, at least one pad within the pouch, and a tie adapted to removably loop between the neck and instrument body at the neck attachment.

11. The instrument harness of claim 10 wherein the peg belt includes holes adapted to fit on the tuning pegs.

12. The instrument harness of claim 10 further comprising an eyelet at the free end of the bottom extension adapted to be removably attached to the instrument at the anchor.

13. The instrument harness of claim 10 wherein the neck connector includes a neck extension and a back extension, the back extension forming a loop attached to the outer surface of the sash, the neck extension attached to the loop and having the neck connector free end detachably attached to the free end of the top extension.

14. An instrument harness for a stringed instrument that includes a body, a neck extending away from the body at a neck attachment, a peg box with pegs at the free end of the neck, and an anchor on the body opposite the neck, the harness comprising:

(a) a strap assembly having a sash with a top end, a bottom end, an outer surface, and an inner surface, the strap assembly including a bottom extension extending from the bottom end of the sash with an adjustable length to a free end having an eyelet adapted to be removably attached to the instrument at the anchor, and a top extension extending from the top end of the sash to a free end;

(b) a plurality of sash cushions removably attachable to the inner surface of the sash;

(c) a back extension forming a loop attached to the outer surface of the sash near the top end;

(d) a neck extension attached to the back extension loop and adapted to removably loop between the neck and instrument body at the neck attachment, the neck extension having an adjustable length, a free end of the neck extension being detachably attached to the free end of the top extension;

(e) a peg belt adapted to removably wrap around the peg box, the peg belt having holes adapted to fit on the tuning pegs, the peg belt being detachably attached to the neck connector; and (f) a chest cushion, the chest cushion having a pouch, at least one pad within the pouch, and a tie adapted to removably loop between the neck and instrument body at the neck attachment.

* * * * *